US006346031B1

(12) United States Patent
Lambert et al.

(10) Patent No.: US 6,346,031 B1
(45) Date of Patent: Feb. 12, 2002

(54) METHOD OF METERING FLUID POLISHING AGENTS AND METERING APPARATUS FOR SAME

(75) Inventors: Helmut Lambert, Rodermark; Uwe Eppler, Hamm, both of (DE)

(73) Assignees: Politec GmbH; Gesellschaft für Schleif- und Poliertechnik Ruchelnheimstrasse, both of (DE)

( * ) Notice: Subject to any disclaimer, the term of this patent is extended or adjusted under 35 U.S.C. 154(b) by 0 days.

(21) Appl. No.: 09/404,664

(22) Filed: Sep. 23, 1999

(30) Foreign Application Priority Data

Oct. 1, 1998 (DE) ..... 198 45 241

(51) Int. Cl.[7] ..... B24B 1/00
(52) U.S. Cl. ..... 451/36; 451/446
(58) Field of Search ..... 451/36, 60, 251, 451/446

(56) References Cited

U.S. PATENT DOCUMENTS 3,593,466 A * 7/1971 Bell ..... 451/446
3,813,044 A 5/1974 Westenberger
4,059,929 A * 11/1977 Bishop ..... 451/446
4,825,736 A * 5/1989 Catanese ..... 82/1.11
5,305,554 A * 4/1994 Emken et al. ..... 451/446
5,807,163 A * 9/1998 Perry ..... 451/36
5,857,893 A * 1/1999 Olsen et al. ..... 451/5
5,921,849 A * 7/1999 Kim et al. ..... 451/60
5,957,759 A * 9/1999 Cardenas et al. ..... 451/60
5,993,299 A * 11/1999 Chen et al. ..... 451/60
6,161,533 A * 12/2000 Katsumata et al. ..... 125/21
6,183,341 B1 * 2/2001 Melcer ..... 451/5

FOREIGN PATENT DOCUMENTS

JP 08012361 1/1996

* cited by examiner

*Primary Examiner*—Derris H. Banks
*Assistant Examiner*—Hadi Shakeri
(74) *Attorney, Agent, or Firm*—Fulbright & Jaworski L.L.P.

(57) ABSTRACT

In the controlled application of fluid polishes to polishing wheels (16) a controlled nozzle head is used which has a polish chamber (12), a nozzle (14) and a valve body (10), the polish being fed to the polish chamber (12) from an external supply tank (2). In order to reduce the apparatus cost, the wasting of polish and the contamination of the surrounding area by fast adaptation of the metering properties, the polish is fed to the nozzle head (1) by means of an external high-pressure pump (21). The nozzle head (1) is moved transversely across at least one polishing wheel (16), and the valve body (10) is controlled, regardless of the supply pressure of the high-pressure pump (21), by at least one external control dependent upon the movement of the nozzle head (1). In a metering apparatus especially appropriate for this use the valve body (10) is controlled by signals which issue from cams which are arranged parallel to the line of movement of the nozzle head.

25 Claims, 2 Drawing Sheets

1
2
3
4
5
6
7
8
9
10
11
12
13
14
15
16
17
18
19
20
21
22
23
24
24a
25
26
27
28

FIG. 2
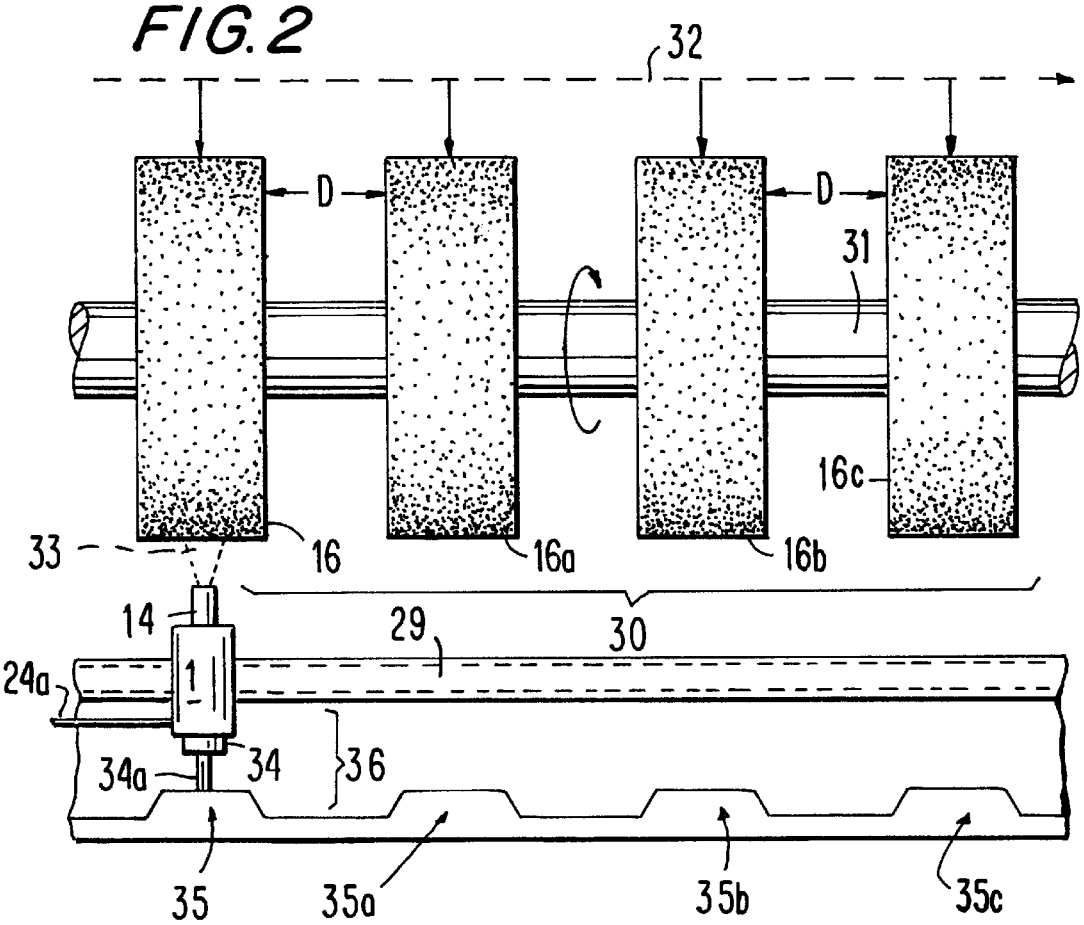
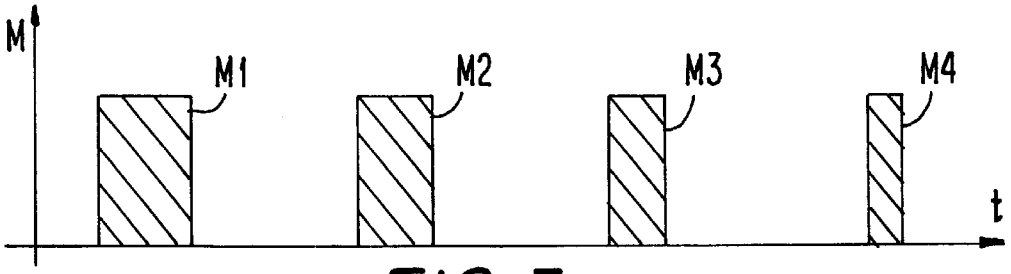
FIG. 3
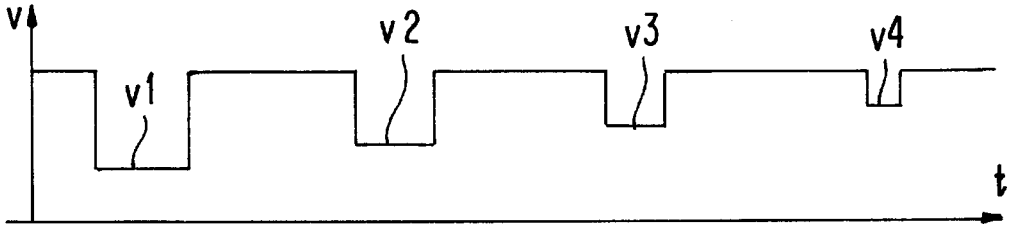
FIG. 4

METHOD OF METERING FLUID POLISHING AGENTS AND METERING APPARATUS FOR SAME

BACKGROUND AND SUMMARY OF THE INVENTION

The invention relates to a method for metering fluid polishing agents according to the preamble of claim 1, and a metering apparatus according to the preamble of claim 8. It is known to apply fluid polishes either by high-pressure or by low-pressure methods, either continuously or intermittently to polishing wheels. The term, "polishes," as used herein, is to be understood to mean suspensions of abrasive solids in liquids, which may also be emulsified. "Polishes" also include grinding agents, inasmuch as the transition from grinding to polishing is seamless. In like manner, the term "polishing wheels" is to be understood to signify flexible, absorbent grinding wheels which consist of textile materials.

Disadvantages of conventional high-pressure apparatus consist in the fact that the application of polish is irregular, resulting in an uneven polishing process and in severe wear on mechanical parts of the polishing machine. Furthermore, considerable imbalance of the polishing wheels has been observed, resulting in damage to the bearings of the polishing shaft. Disadvantages of the low-pressure apparatus of the prior art consist in severe turbulence of the polishing agent, produced by the air turbulence caused by the polishing wheels, with the result that the area surrounding the polishing machine and the polishing machine itself become very contaminated, and that a great percentage of expensive polish is lost. Polish that has not been absorbed by the polishing wheels and/or flung away by the latter cannot be reused due to contamination of the polishing agent itself. Therefore additional waste matter is produced which has to be disposed of with difficulty and at great expense.

German patent DE 22 42 030 C3 discloses a high-pressure metering gun of very complex design for the application of polishing agents, in which the pressure of the polishing agent that is present in the polish chamber serves for the automatic control of the valve body and its piston rod which have the action of a differential pump. The continuous delivery of polish provides for a periodical pressure increase to which the differential piston yields after a time by letting a specific amount of the polish exit through the nozzle. This causes a pressure drop which in turn leads to a closing of the valve body. Therefore periodical pressure and spraying pulses continually develop with time-related intensity and velocity variations. This can also be described by saying that the metering constantly fluctuates between a high-pressure feed and a low-pressure feed, resulting in an alternation of the disadvantages of both kinds of metering. The frequency of the metering pulses amounts to around several Hertz.

To be able to vary the integral rate of flow of the polish, the differential piston according to DE 22 42 030 C3 is under the action of a compression spring whose bias can be varied by an adjusting knob provided on the feeding gun. In the case of a linear array of polishing wheels, since this knob moves along with the feeding gun, changing the adjustment is difficult if not even impossible without shutting off the gun. It is especially impossible to periodically stop and start the gun according to its location as it crosses intervals between the polishing wheels, so that the above-described contamination of the polishing machine and its surroundings occurs, with its likewise described consequences.

Through DE 37 28 714 A1 it has become known, in the case of an intermittently operating high-pressure metering apparatus for polishing paste, to feed this polishing paste at a low, undefined pressure, which can also be no more than a hydrostatic pressure, to a reservoir chamber of the smallest possible capacity disposed in the housing ahead of the nozzle. The high pressure is produced by the timed operation of a compressed-air piston of large diameter which acts on a plunger of considerably smaller diameter, which thereby constitutes a second (differential) piston for the nozzle which has its own, spring-loaded ball valve. When the response limit of this ball valve is exceeded it opens, and after ejecting a portion of the polish it closes again automatically, i.e., the operation of the known apparatus is substantially controlled by pressure. The movement of the metering apparatus relative to and transversely across the polishing wheel is not described any more than is the distance-related and synchronized actuation of the metering device as it crosses over the polishing wheel. The known apparatus is also surprisingly unsuitable for such synchronization, because it operates too sluggishly on account of the pressure-dependent movement of the two pistons. On the basis of the problem to which it is addressed, the known solution offered deals with the entirely different problem of automatic supervision of all the important operations within the metering apparatus by means of a pressure sensor and an end-position sensor for the compressed-air piston, but it does not specifically deal with the positioning of the metering device. DE 1 997 213 U discloses an apparatus for the movement of at least one nozzle for grinding and polishing agents, and with means for the reversal of the nozzle(s) at the ends of the given maximum travel, which as a rule substantially exceeds the width of a polishing wheel, so that as the spraying process continues away from the polishing wheel a considerable amount of the polish is lost and the machine and its surroundings are contaminated. The solution offered deals, on the basis of the stated problem, with the entirely different problem of preventing the penetration of grinding and polishing agents into the drive and guidance mechanism of the nozzle(s) by encapsulation. No distance-related synchronization of spray cycles is disclosed and none is addressed.

In the known apparatus and methods, spray nozzles are always used which produce an outspread stream of diffused droplets, which results in additional losses of polishing agent and in contamination of the polishing machines and their surroundings. In contrast, the invention is addressed to the problem of teaching a metering method and a metering apparatus which require little investment in apparatus and can be quickly adapted to various metering conditions. In particular, the metering process is to be accessible also to programming and/or remote control.

The solution of the stated problem is accomplished in the metering method according to the present invention. Such a method and such an apparatus require but a small investment in apparatus and can quickly be adapted to various metering conditions; in particular, the metering process can also be made accessible to programming and/or remote control. This brings it about that the application of the polish to the periphery of each polishing wheel is uniform, resulting in a uniform polishing process, and it prevents the unbalancing of the polishing wheels and premature wearing out of mechanical parts of the polishing machine.

Severe turbulence of the polishing agent is no longer seen, so that the surroundings of the polishing machine and the polishing machine itself become less severely contaminated and only a very small percentage of the expensive polishing agent is lost. Thus less special-class waste matter is generated so that disposal costs are reduced. This is especially the case when the nozzle is one which when opened produces a solid stream of the polish.

In case of an arrangement of polishing wheels in a linear array along which the metering apparatus travels, changing the setting is extremely simple and can be done without stopping. It is especially possible to shut off the metering apparatus periodically in the marginal areas of the polishing wheels and/or when passing over gaps between the polishing wheels, so that the above-described soiling of the polishing machine and its surroundings with the consequences described is eliminated. The feed rate can be influenced by the following parameters: nozzle geometry, valve body open time, and pressure in the polish chamber. All parameters are controllable individually and independently of one another, without manipulations at the nozzle head itself.

Pursuant to embodiments of the process—either individually or in combination—it is especially advantageous if

- the opening and closing times of the valve body are controlled by square pulses,
- in a linear array of several polishing wheels spaced apart along a polishing shaft, at least one nozzle head is moved along the row substantially parallel to the polishing shaft, and if the valve body is opened when crossing a polishing wheel and closed when crossing the spaces,
- the open time of the valve body from one polishing wheel to the other is varied, especially if the open time of the valve body is made to diminish from the first to the last polishing wheel while carrying the material being polished parallel to the polishing shaft,
- the speed of the travel of the nozzle head is reduced while passing over the polishing wheels and increased while passing over the spaces between them, especially if the traveling speed of the nozzle head, when the material being polished is carried parallel to the polishing shaft, is made to increase from the first to the last polishing wheel.

It is especially advantageous in further embodiments of the metering apparatus if, either alone or in combination:

- the valve body is connected with a control piston which is housed in a control chamber separate from the polish chamber, and if the control chamber is connected to a hydraulic pump which is controllable by an external timer,
- both sides of the control piston can be acted upon by the hydraulic fluid,
- the polish chambers and the control chambers are arranged in rows running in the direction of movement of the valve body and are sealed against one another,
- the polish chambers and the control chambers are housed in a common cylindrical body,
- the valve body is replaceable on the piston rod and cooperates with the nozzle.
- the nozzle head can be made to travel by means of a driving device at least substantially parallel to a polishing shaft,
- the nozzle head is connected to a control apparatus by which it can be moved along an linear array of a plurality of polishing wheels on a polishing shaft, and by which the nozzle head can be activated when passing over the polishing wheels and can be stopped when passing over the intervals between them,
- the nozzle head is connected to a control apparatus by which the open periods of the valve body can be varied from one polishing wheel to the next, especially to a control apparatus by which the open periods of the valve body can be shortened as the material being polished is carried parallel to the polishing shaft from the first to the last polishing wheel,
- the nozzle head is connected to a control apparatus by which the speed of travel of the nozzle head as it passes over the polishing wheels can be reduced and can be increased as it passes over the intervals, especially to a control apparatus by which the speed of travel of the nozzle head can be increased from the first to the last polishing wheel as the material being polished is carried parallel to the polishing shaft.

An embodiment and the possibilities for its use are further explained below with the aid of FIGS. 1 to 4.

DETAILED DESCRIPTION

Figure 1:
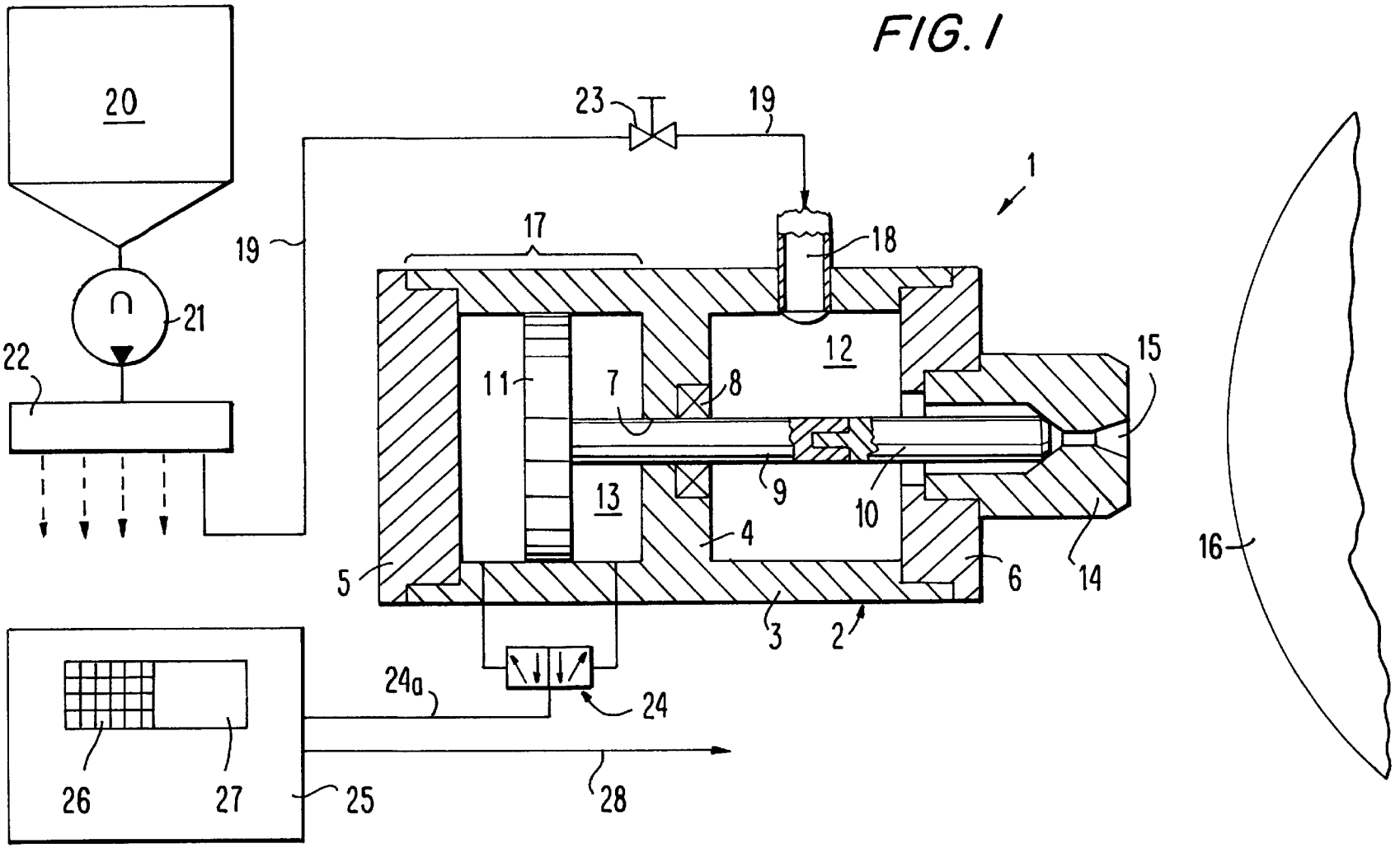
FIG. 1 shows an axial section through a nozzle head, plus the important peripheral apparatus, FIG. 2 a top plan view of a linear array of several polishing wheels, a nozzle head and its displacement system, as well as a direction of transport of the polish, FIG. 3 a diagram of the time-related and travel-related variation of the rate of feed of the nozzle head in connection with an apparatus according to FIG. 2, and FIG. 4 a diagram of the variation of the rate of displacement of the nozzle head with respect to time and transport, in connection with an apparatus according to FIG. 2.

In FIG. 1 a nozzle head 1 is represented, with which there is related a housing 2 with a cylindrical body 3, a dividing wall 4 and two end closures 5 and 6. In the dividing wall 4 there is a through bore 7 and an annular seal 8 for a piston rod 9 which carries a valve body 10 and is connected with a double-acting control piston 11. In this manner a polish chamber 12 and a control chamber 13 are formed in the cylindrical body 3.

In the end closure 6 there is a nozzle 14 as a stopper—which is replaceable—of the polish chamber 12, which can be replaced with another one having a different bore 15 and a different spray angle. The nozzle 14 can be designed for a spray, that is a stream of droplets, but preferably for a solid, thin jet of polishing agent. The nozzle bore 15, when in operation, is aimed toward at least one polishing wheel 16. The valve body 10 can be fastened removably, as shown, to the piston rod 9, but does not need to be. The right end of the valve body 10 has a coaxial leading edge, and the nozzle 14 has a valve seat complementary thereto. The parts on the left of the dividing wall 4 form a driver 17 therefor.

A polishing agent supply line 19 is connected to the polish chamber 12 through a connecting piece 18. This line 19 runs from a polish reservoir 20 first to a high-pressure pump 21 and then to a manifold 22 which permits the connection of a plurality of spray heads. A shut-off-valve 23 permits replacement of the nozzle head 1 and/or the nozzle 14.

The driver 17 is connected through a two-way valve 24 and an air line 24*a* to an external control unit 25 to which a keyboard 26 and a display unit 27 belong. A pressure medium source, not shown, and several data banks for storing and issuing time and travel signals, are included in the control unit 25. The outputs for the pressure medium and the signals, as well as any inputs for external travel signals, also are not especially represented. Only a control line 28 for a transport system 29 (FIG. 2) for the displacement of the nozzle head 1 is indicated symbolically.

By means of the external control unit 25 the valve body 10 can be operated only in relation to time, i.e., the pressure of the polish in the polish chamber 12 and the cooperation of the valve body 10 with the nozzle 14 have at least no marked influence on the operating cycle, i.e., on the open time and closed time. The rate of flow of polish, however, can additionally be influenced by the pressure of delivery to the polish chamber 12 and through the nozzle 14. By means of the external control unit 25 the nozzle head 1 can also be controlled in relation to its movement, with the aid if desired of movement monitors arranged along the path of movement or on the threaded spindle of the movement apparatus, which will be described in greater detail below.

In FIG. 2 a linear array 30 of a plurality of polishing wheels 16, 16*a*, 16*b* and 16*c*, is represented which are disposed on a common polishing shaft 31. The latter runs parallel to the transport system 29, which is in the form of a threaded spindle, and parallel to a transport path 32 for the transport of polishing material. The polishing material, not shown, is carried along this transport path 32 in a conventional manner along the polishing wheels 16 to 16*c*. For the sake of simplicity, the motor drive for the transport system 29, which is controlled through the control line 28 (FIG. 1), is not shown, either.

The driver 17 can be controlled in various ways: It is possible to enter and store positioning commands for the transport system 29 in the control unit 25. At the same time the correlation of the positioning commands can also be varied in order to optimize the local rate of delivery. It is furthermore possible to produce travel signals from travel indicators with electrical outputs and feed them back through electrical signal lines to the control unit 25 (FIG. 1) and report them from there through line 24*a* to the two-way valve 24.

A simpler "on-site" control, however, is additionally represented in FIG. 2: a two-way valve 34 with a cam follower pin 34*a* is associated with the nozzle head 1, as is a control system 36 in the form of a cam bar with cams 35, 35*a*, 35*b* and 35*c*, whose position corresponds to the position of the polishing wheels 16 to 16*c*. Thus the cams in conjunction with the feeler pin 34*a* produce travel signals having the function described above. It is necessary only to connect the nozzle head 1 (in addition to the reservoir 2) to the air line 24*a* configured as a trailing line.

FIG. 3 shows with the aid of a diagram the time-and-distance related feed "M" by the control unit 25 and/or 36 in connection with an apparatus according to FIG. 2. As it passes over the polishing wheels 16 to 16*c*, a jet 33 of polish is directed against these polishing wheels, preferably into the axial center area of these polishing wheels, so that polish will not be sprayed unnecessarily beyond the edges of the polishing wheels and thus be wasted, which would also contaminate the surroundings. This is expressed in the diagram of FIG. 3 in that the width of the hatched rectangles, which represent the amounts of polish, is less in the direction of the time axis "t" than the width of the polishing wheels. Since usually a preliminary or rough polishing is performed by the first polishing wheel (as seen in the direction of transport), but on the last polishing wheel 16*c* (as seen in the direction of transport) a fine or finish polish is applied, the polish amounts M1, M2, M3 and M4 are made to decrease in this direction, which is expressed in the diagram by a decreasing width of the hatched rectangles. When the intervals "D" between the polishing wheels are crossed, the nozzle 14 is in each case closed.

FIG. 4 shows with the aid of a diagram the time and distance related variation of the speed of travel "v" of the nozzle head in connection with an apparatus according to FIG. 2. When the intervals "D" between the polishing wheels are passed over, the rate of speed is at its highest in order to shorten the spray cycles. When passing over the polishing wheels 16 to 16*c* themselves, the speed of travel "v" is reduced each time. Since on the first polishing wheel 16 a preliminary or rough polishing takes place, but a fine or finished polish is applied at the last polishing wheel 16*c*, the speeds of displacement v1, v2, v3 and v4 are made to increase, as indicated in FIG. 4. By these means and measures the necessary amounts of polishing material can be adapted to the local need. The contamination of the surroundings, the consumption of polish and the cost of equipment are thus reduced to a minimum.

It is entirely possible to replace the pneumatic or hydraulic driver with a magnetic driver, thereby simplifying the wiring and reducing its cost and increasing the speed of movement of the valve body 10.

We claim:

1. A method for metering a fluid polishing agents' when applied to the periphery of at least one polishing wheel having a polishing shaft by means of a controlled nozzle head having a polish chamber, a nozzle and a valve body and having open and close times, the fluid polishing agent being fed to said polish chamber from an external reservoir, comprising a. feeding the fluid polishing agent to the nozzle by an output pressure of an external high-pressure pump;

b. moving the nozzle head at a travel speed transversely across a periphery of the at least one polishing wheel and parallel to said polishing shaft; and c. controlling the valve body within said nozzle head independently of said output pressure by at least one external time and travel signal for a prescribed path parallel to said polishing shaft depending on a position of the said at least one polishing wheel and on a movement of the nozzle head with the valve body such that the fluid polishing agent is concentrated at least substantially on said periphery of said at least one polishing wheel.

2. The method according to claim 1, wherein the open and close times of the valve body are controlled by square pulses.

3. The method according to claim 1, wherein when a linear array of a plurality of polishing wheels at intervals (D) on said polishing shaft are provided, at least one nozzle head is moved along the linear array parallel to the polishing shaft, and the valve body is opened when passing over the polishing wheels and the valve body is closed when passing over said intervals (D).

4. The method according to claim 3, wherein the open times of the valve body are selected differently from polishing wheel to polishing wheel.

5. The method according to claim 4, wherein a first and a last polishing wheel are provided and the open times of the valve body are selectively decreased when a material to be polished is transported parallel to the polishing shaft from the first to the last polishing wheel.

6. The method according to claim 3, wherein the travel speed of said at least one nozzle head when crossing over the polishing wheels is reduced and when passing over intervals (D) between polishing wheels it is increased.

7. The method according to claim 6, wherein said travel speed of said at least one nozzle head in case of a polish transport parallel to said shaft is increased selectively from the first to the last polishing wheel.

8. The method according to claim 6, wherein said nozzle is a nozzle for issuing a solid stream of polish.

9. A metering system for a fluid polish for application to a periphery of at least one polishing wheel, having a polishing shaft comprising a controllable nozzle head having a polish chamber, a nozzle and a valve body within said nozzle head, the polish chamber being connected to an external reservoir being followed by an external high pressure pump via a polish conduit, wherein the polish chamber is connected to said external high-pressure pump by which a pressure ahead of the nozzle can be produced which corresponds to a supply pressure of the high-pressure pump, the nozzle head is disposed on a driving system whose driving direction runs parallel to the periphery and to the polishing shaft of said at least one polishing wheel, and that the metering system has an actuator which is connected to a control unit from which distance signals can be fed to the actuator for a position-related operation of said valve body for metering of the polish, such that the polish is concentrated at least substantially on the periphery of the at least one polishing wheel.

10. The metering system according to claim 9, wherein the valve body is connected to a control piston which is contained in a control chamber separate from the polish chamber, and said external high-pressure pump can be controlled by an external timer.

11. The metering system according to claim 10, wherein the control piston has two sides and can be acted on both sides by hydraulic fluid.

12. The metering system according to claim 10, wherein the polish chamber and the control chamber are in series in a direction of movement of the valve body and are sealed from one another.

13. The metering system according to claim 12, wherein the polish chamber and the control chamber are contained in a common cylindrical body.

14. The metering system according to claim 9, wherein the valve body is replaceably disposed on a piston rod cooperating with the nozzle.

15. The metering system according to claim 9, wherein the nozzle head can be made to travel substantially parallel to said polishing shaft by a driving system.

16. The metering system according to claim 9, wherein the nozzle head is connected to a control system by which it can be moved along a linear array of a plurality of polishing wheels disposed on said polishing shaft, and by which the nozzle head can be activated when passing over the polishing wheels and shut off when passing over intervals (D) between the polishing wheels.

17. The metering system according to claim 16, wherein the nozzle head is connected to a control system by which the open times of the valve body can be adjusted differently from polishing wheel to polishing wheel.

18. The metering system according to claim 17, wherein the nozzle head is connected to a control system by which the open times of the valve body, when materials to be polished are being transported parallel to the polishing shaft, can be adjusted decreasingly from a first to a last polishing wheel.

19. The metering system according to claim 16, wherein the nozzle head is connected to a control system by which a speed of travel of the nozzle head can be lowered when passing over said polishing wheels and raised when passing over said intervals (D) between said polishing wheels.

20. The metering system according to claim 16, wherein the nozzle head is operatively connected to a nozzle head control system which can increase a speed of travel of the nozzle head from a first to a last polishing wheel when material to be polished is being transported parallel to the polishing shaft.

21. The metering system according to claim 9, wherein said nozzle emits a solid stream of polish.

22. The metering system according to claim 9, wherein a control valve is directly associated with the nozzle head, and further comprising a nozzle head control system comprising at least one control cam, being disposed along a path of travel of the nozzle head, by which the nozzle head is controllable.

23. The metering system according to claim 22, wherein a plurality of control cams having widths are disposed on a cam bar.

24. The metering system according to claim 23, wherein the control cams are adjustable relative to one another and to the polishing wheels.

25. The metering system according to claim 22, wherein a width of said at least one control cam is variable.

* * * * *